US005393054A

United States Patent [19]

Rouffer

[11] Patent Number: 5,393,054

[45] Date of Patent: Feb. 28, 1995

[54] PAINT BALL

[75] Inventor: Mark Rouffer, Windsor, Canada

[73] Assignee: ZAP Paintball Corporation, Windsor, Canada

[21] Appl. No.: 208,344

[22] Filed: Mar. 9, 1994

[51] Int. Cl.[6] ..... A63B 43/00

[52] U.S. Cl. ..... 273/58 H; 428/34.1

[58] Field of Search ..... 273/58 R, 58 H; 428/34.1

[56] References Cited

U.S. PATENT DOCUMENTS 5,254,379 10/1993 Kotsiopoulos et al. ..... 273/58 R X

*Primary Examiner*—William H. Grieb

*Attorney, Agent, or Firm*—Gifford, Krass, Groh, Sprinkle, Patmore, Anderson & Citkowski

[57] ABSTRACT

A paint ball is disclosed having a gelatin capsule which defines a closed interior chamber. A fill material is contained within the interior chamber and this fill material contains 1%-65% polyethylene glycol, 25%-45% starch, up to 0.5% dye and the balance water. Additionally, the capsule material contains 9%-17% sorbitol, 35%-45% gelatin, 10%-20% glycerine, up to 10% starch, up to 0.5% color and the balance water.

15 Claims, No Drawings

PAINT BALL

BACKGROUND OF THE INVENTION

I. Field of the Invention

The present invention relates generally to paint balls and, more particularly, to a novel paint ball having a novel capsule composition and a novel fill material.

II. Description of the Prior Art

The sport or recreational activity known as "War Games" is perhaps one of the fastest growing sports in North America. In the sport of War Games, two or more teams are each equipped with gas powered guns which shoot paint balls. Typically, the paint balls are propelled by compressed carbon dioxide.

In the sport of War Games, the players are arranged into teams and shoot paint balls at members of the opposing teams. When the paint ball strikes an opponent of the opposing team, the paint ball shatters and releases the fill material or "paint" on the player. In doing so, the player who has been struck by the paint ball is marked and disqualified from continuing the game.

The previously known paint balls typically comprise an outer capsule which forms an interior chamber. This interior chamber contains the "paint" which marks the player during the play of the game as the outer shell shatters upon impact. These previously known paint balls, however, have suffered from a number of disadvantages.

A primary disadvantage of these previously known paint balls is that the capsule for the paint balls are brittle and can shatter in the gun when fired. The brittleness of these previously known capsule also requires a relatively high level of care in handling the paint balls in order to avoid breakage of the paint balls.

A still further disadvantage of these previously known paint balls is that a paint ball contains a relatively high level of polyethylene glycol in the fill material or "paint". This polyethylene glycol is not only relatively expensive, but also potentially hazardous to the environment.

A still further disadvantage of these previously known paint balls is that the paint balls suffer firing inaccuracy. As such, these previously known paint balls have poor long range accuracy.

SUMMARY OF THE PRESENT INVENTION

The present invention provides a paint ball which overcomes all of the above mentioned disadvantages of the previously known paint balls.

In brief, the paint ball of the present invention comprises a gelatin capsule defining a closed interior chamber. A fill material is contained within the interior chamber and it is this fill material which "marks" the player upon impact and breakage of the gelatin capsule.

The fill material preferably comprises 1%–65% polyethylene glycol, 25%–45% starch and up to 0.5% dye with the balance water. Thus, unlike the previously known paint balls, the paint ball fill material of the present invention contains starch and, in doing so, reduces the amount of polyethylene glycol required for the fill material.

The gelatine capsule for the paint ball of the present invention comprises 9%–17% sorbitol, 35%–45% gelatine, 10%–20% glycerine, up to 10% starch, up to 0.5% color with the balance water. Consequently, unlike the previously known gelatine capsules used in paint balls, the gelatine capsule of the present invention utilizes starch in its composition.

The paint ball of the present invention exhibits less brittleness than the previously known paint balls thus minimizing the likelihood of breakage of the paint ball during firing of the gun or at other inopportune times. Furthermore, the paint ball of the present invention is somewhat denser than the previously known paint balls which enhances its ballistic characteristics and improves its firing accuracy.

DETAILED DESCRIPTION OF A PREFERRED EMBODIMENT OF THE PRESENT INVENTION

The paint ball of the present invention is generally spherical in shape thus having a spherical gelatin capsule which defines a closed interior spherical chamber. This closed interior chamber is filled with the fill material or "paint". In use, the paint ball is fired by a gas powered gun at a target and, upon impact with the target, the gelatin capsule shatters and releases the fill material against the target.

The fill material of the preferred embodiment of the present invention comprises 1%–65% polyethylene glycol, 25%–45% starch, up to 0.5% dye and the balance water. Thus, unlike the previously known paint balls, the paint ball fill material of the present invention contains a relatively high percentage of starch and a relatively low percentage of polyethylene glycol.

The polyethylene glycol (PEG) has a mean molecular weight of between 200 and 4000 and preferably comprises at least two polyethylene glycols, each of which has a different molecular weight. In particular, the one polyethylene glycol preferably has a molecular weight of substantially 400 and forms the base liquid ingredient for the fill. PEG 400 forms between 45% and 65% and preferaby 50% to 55% by weight of the fill material.

Another polyethylene glycol has a mean molecular weight of greater than 3000, preferaby PEG 3350. PEG 3350 acts as a thickening agent and forms between 1%–5% and preferably 2%–3% by weight of the fill material.

The fill material can also contain a third polyethylene glycol which preferably has a mean molecular weight of about 200. PEG 200 constitutes 1%–3% by weight of the fill material and provides anti-freeze properties to the fill material as well as protect the shell against embuttement by diffusion of the fill material.

The polythylene glycol mixture also contains 1%–3% and preferably 1%–2% glycerin by weight.

The starch forms a suspension with the PEG base and forms a reflective substrate for the dye. Although the fill can contain 25%–45% by weight starch, preferably it contains 35%–42% by weight. Any of a plurality of different starches can be employed for the fill material. Preferably, the starch is selected from the group of corn starch, potato starch and/or processed starch such as Hylon V or Hylon VII.

The following is an example of a preferred embodiment of the fill material for the paint ball of the present invention.

EXAMPLE 1

| Constituent | Percent (by weight) |
|---|---|
| PEG 400 | 52 |
| PEG 3350 | 2 |

-continued

| Constituent | Percent (by weight) |
|---|---|
| PEG 200 | 1 |
| STARCH | 42% |
| DYE | .02% |
| WATER | BALANCE |

The paint ball capsule comprises 9%–17% sorbitol, 35%–45% gelatine, 10%–20% glycerine, up to 10% starch, up to 0.5% color and the balance of water. Thus, unlike the previously known paint ball gelatine capsules, the capsule of the present invention contains starch.

The capsule can further include at least one sorbitan, a polyhydric acid and up to 3% mannitol.

The following is an example of a preferred composition for the gelatin capsule.

EXAMPLE 2

| Constituent | Percent (by weight) |
|---|---|
| GELATIN | 40% |
| GLYCERINE | 10.4 |
| SORBITOL | 10.4 |
| STARCH | 4.8 |
| WATER | BALANCE |

In practice, the paint ball according to the present invention has found to be less brittle than the previously known paint balls. As such, breakage of the paint balls in the gun during firing as well as other inopportune times, it minimized. Less breakage of the paint balls also occurs during normal handling of the paint balls.

Additionally, the paint ball of the present invention is more dense than the previously known paint balls. This enhances the ballistic characteristics of the paint ball thus improving its overall long range firing accuracy.

It has also been found that the starch in the gelatin capsule provides a non-stick surface on the paint ball which reduces friction during both rapid loading as well as in the gun barrel. The overall appearance for the shell also has a matted look rather than high gloss which may also improve its ballistic characteristics.

Having described my invention, however, many modifications thereto will become apparent to those skilled in the art to which it pertains without deviation from the spirit of the invention as defined by the scope of the appended claims.

I claim:

1. A paint ball comprising a gelatin capsule defining a closed interior chamber, a fill material contained within said interior chamber, said fill material comprising 1%–65% polyethylene glycol, 25%–45% starch, up to 0.5% dye and the balance water.

2. The invention as defined in claim 1 wherein said polyethylene glycol has a mean molecular weight of between 200 and 4000.

3. The invention as defined in claim 1 wherein said polyethylene glycol further comprises at least two polyethylene glycols, each polyethylene glycol having a different molecular weight.

4. The invention as defined in claim 3 wherein one polyethylene glycol has a mean molecular weight of substantially 400 and another polyethylene glycol has a mean molecular weight greater than 3000.

5. The invention as defined in claim 4 wherein said polyethylene glycol further comprises a third polyethylene glycol having a mean molecular weight of substantially 200.

6. The invention as defined in claim 1 wherein said starch is selected from the group of corn starch, potato starch and processed starch.

7. The invention as defined in claim 1 wherein said capsule comprises 9%–17% sorbitol, 35%–45% gelatin, 10%–20% glycerine, up to 10% starch, up to 0.5% color and the balance water.

8. The invention as defined in claim 7 wherein said capsule further comprises at least one sorbitan, a polyhydric acid and up to 3% mannitol.

9. The invention as defined in claim 1 wherein said fill material contains 35%–42% by wieght starch.

10. The invention as defined in claim 4 wherein said polyethylene glycol having a molecular weight of greater than 3000 constitutes 1%–5% by wieght of said fill material.

11. The invention as defined in claim 5 wherein said polyethylene glycol having a molecular weight of substantially 200 constitutes 1%–3% by weight of the fill material.

12. The invention as defined in claim 1 wherein said polyethylene glycol constitutes 45%–65% by weight of the fill material.

13. The invention as defined in claim 12 wherein said polyethylene glycol constitutes 50%–55% by weight of the fill material.

14. The invention as defined in claim 7 wherein said capsule further comprises at least one sorbitan, a polyhydric acid and up to 3% mannitol.

15. A paint ball comprising a gelatin capsule defining a closed interior chamber, a fill material contained within said interior chamber, wherein said capsule comprises 9%–17% sorbitol, 35%–45% gelatin, 10%–20% glycerine, up to 10% starch, up to 0.5% color and the balance water.

* * * * *